US007886958B2

(12) United States Patent
Smith

(10) Patent No.: US 7,886,958 B2
(45) Date of Patent: Feb. 15, 2011

(54) CONTAINER HAVING AN AUTOMATICALLY LOCKING BOTTOM AND BLANKS FOR MAKING THE SAME

(75) Inventor: Kenneth Charles Smith, Hiram, GA (US)

(73) Assignee: Smurfit-Stone Container Enterprises, Inc., Chicago, IL (US)

( * ) Notice: Subject to any disclaimer, the term of this patent is extended or adjusted under 35 U.S.C. 154(b) by 116 days.

(21) Appl. No.: 12/209,949

(22) Filed: Sep. 12, 2008

(65) Prior Publication Data

US 2010/0065620 A1 Mar. 18, 2010

(51) Int. Cl.
*B65D 5/36* (2006.01)
*B65D 5/10* (2006.01)

(52) U.S. Cl. ..... 229/117; 229/109; 229/157

(58) Field of Classification Search ..... 229/108.1, 229/109, 110, 117, 157
See application file for complete search history.

(56) References Cited

U.S. PATENT DOCUMENTS

| | | | | | |
|---|---|---|---|---|---|
| 2,348,378 | A | * | 5/1944 | Goodyear | 229/117 |
| 2,826,350 | A | * | 3/1958 | Marx | 229/110 |
| 3,501,081 | A | | 3/1970 | Paige | |
| 3,517,875 | A | * | 6/1970 | Wakefield | 229/117 |
| 3,809,310 | A | * | 5/1974 | VanderLugt, Jr. | 229/110 |
| 4,007,869 | A | * | 2/1977 | Stolkin et al. | 229/117 |
| 4,063,679 | A | * | 12/1977 | Henry | 229/108.1 |
| 4,094,459 | A | | 6/1978 | Coons | |
| 4,187,976 | A | * | 2/1980 | Mather | 229/117 |
| 4,218,009 | A | | 8/1980 | Don Carlos | |
| 4,264,031 | A | * | 4/1981 | Goebel | 229/110 |
| 4,289,268 | A | | 9/1981 | Paige | |
| 4,291,828 | A | | 9/1981 | Nigro | |
| 4,530,460 | A | | 7/1985 | Hinton | |
| 4,572,424 | A | | 2/1986 | Muise et al. | |
| 4,583,678 | A | | 4/1986 | Weimer, Jr. | |
| 4,702,408 | A | | 10/1987 | Powlenko | |
| 5,042,714 | A | | 8/1991 | Hall | |
| 5,066,269 | A | | 11/1991 | Center et al. | |
| 5,522,628 | A | | 6/1996 | Fillis | |
| 5,664,726 | A | | 9/1997 | Opper | |
| 5,755,377 | A | * | 5/1998 | Durand | 229/110 |
| 5,927,593 | A | | 7/1999 | Berkowitz et al. | |
| 6,109,513 | A | | 8/2000 | Dugan | |
| 6,290,123 | B1 | | 9/2001 | Pei | |
| 6,349,876 | B1 | | 2/2002 | Dowd | |
| 6,386,437 | B1 | | 5/2002 | Larson, Jr. | |
| 6,530,516 | B1 | | 3/2003 | Ritter | |

(Continued)

*Primary Examiner*—Gary E Elkins
(74) *Attorney, Agent, or Firm*—Armstrong Teasdale LLP

(57) ABSTRACT

A blank of sheet material for forming a container including automatically locking bottom panels is provided. The blank includes a pair of end panels, a pair of side panels and at least one corner panel that are interconnected. The corner panel extends between an adjacent end panel and side panel. The blank includes bottom end panels extending from the end panels and bottom side panels extending from the side panels. A first coupling tab is integral with a bottom end panel, and a second coupling tab is integral with a bottom side panel. The first coupling tab attaches to a bottom side panel, and the second coupling tab attaches to a bottom end panel. The coupling tabs upwardly direct the bottom panels when the container is moved to a flat position and downwardly direct the bottom panels when the container is moved from the flat position to an erected position.

30 Claims, 7 Drawing Sheets

U.S. PATENT DOCUMENTS

| | | | |
|---|---|---|---|
| 6,557,749 | B1 | 5/2003 | Gill |
| 6,637,645 | B2 | 10/2003 | Ferguson |
| 6,705,515 | B2 | 3/2004 | Dowd |
| 6,761,307 | B2 | 7/2004 | Matsuoka |
| 6,926,192 | B1 | 8/2005 | Dowd |
| 7,055,734 | B2 | 6/2006 | Provus et al. |
| 7,278,565 | B2 | 10/2007 | West |

* cited by examiner

CONTAINER HAVING AN AUTOMATICALLY LOCKING BOTTOM AND BLANKS FOR MAKING THE SAME

BACKGROUND OF THE INVENTION

The field of the invention relates generally to a blank and a container formed from the blank and more particularly, to a container having an automatically locking bottom wherein the container may be collapsed without breaking bonds between bottom panels and re-erected without applying additional adhesive material to the bottom panels.

Containers are frequently utilized to store and aid in transporting products. These containers can be square, hexagonal, or octagonal. The shape of the container can provide additional strength to the container. For example, octagonal-shaped containers provide greater resistance to bulge over conventional rectangular, square or even hexagonal-shaped containers. An octagonal-shaped container may also provide increased stacking strength.

In at least some known cases, an empty container can be shipped in a knocked-down flat state and opened to form an assembled container that is ready for use. Shipping and storing containers in a knocked-down flat state saves money and space, however, the size and configuration of the container can make the setup of the container difficult for an individual to complete. A container that cannot be knocked-down flat or a container that can be knocked-down flat but is difficult to erect can cause unwanted expenses and wasted time.

One known carton, as described in U.S. Pat. No. 4,007,869, includes an automatically-forming bottom. The blank used to form the carton includes four side panels and a bottom panel extending from each of the four side panels. A triangular glue flap extends from an outer edge of each of the two center bottom panels. The carton construction is an overlapped construction, and as such, a pair of opposing bottom flaps are of differing lengths such that one bottom panel of the pair overlaps the other bottom panel of the pair when the carton is erected. The bottom of the carton described in the '869 Patent is formed by folding the bottom panels over onto the side panels and reversely folding the triangular glue flaps as the bottom panels are folded over. The triangular glue flaps and the corresponding portion of the bottom panels are glued together when the blank is folded to form the carton. In a collapsed condition, the bottom panels are positioned within the side walls of the carton. From the collapsed condition, the four-sided carton is erected by applying pressure to the edges of the carton causing it to open into a rectangular shape. At the same time, due to the interconnection of the bottom panels by the triangular glue flaps of the carton, the bottom panels form a secured bottom.

Another known container, as described in U.S. Pat. No. 5,042,714, is a collapsible grocery container made of lightweight plastic or cardboard for receiving a bag of groceries. The container is a four-sided box that may be stored in an upright, folded position. The container includes two bottom wings and two bottom flaps that are folded flush against side, front, and back walls, respectively, when the container is in the folded position. A portion of each bottom flap is glued to an adjacent wing. Each bottom flap includes a notch portion along the bottom edge and also includes a slot that fits into the notch portion on the opposing bottom flap. Thus, the bottom flaps will lock into place with each other when a grocery bag is in the container.

Neither the '829 Patent nor the '714 Patent include eight side walls. One known container, as described in U.S. Pat. No. 6,386,437, includes eights side walls, however, when the container described in the '437 Patent is collapsed, the bottom walls extend outward from bottom edges of the side walls, rather than being received within the side walls. As such, the knocked-down '437 container has a larger area as compared to containers that include bottom panels that are received within the side walls when the container is knocked down, and therefore the '437 container requires more space for storage and is more susceptible to damage. Accordingly, a need exists for an eight-sided container that may be knocked down and re-erected without additional adhesive and/or tape, wherein bottom panels of the container are received within side walls of the container when the container is knocked down flat.

BRIEF DESCRIPTION OF THE INVENTION

In one aspect, a blank of sheet material for forming a container including automatically locking bottom panels is provided. The blank includes a pair of end panels, a pair of side panels and at least one corner panel interconnected to form a pair of opposing end walls, a pair of opposing side walls and a corner wall of the container. The at least one corner panel extends between an adjacent end panel and side panel. The blank includes a plurality of bottom panels for forming a bottom wall of the container, wherein the bottom panels include a pair of bottom end panels each extending from a bottom edge of each of the pair of end panels, and a pair of bottom side panels each extending from a bottom edge of the pair of side panels. A first coupling tab is integral with one of the pair of bottom end panels, and a second coupling tab is integral with one of the pair of bottom side panels. The first coupling tab attaches to one of the pair of bottom side panels, and the second coupling tab attaches to one of the pair of bottom end panels. The coupling tabs are configured to upwardly direct the bottom panels when the container is moved from an erected position to a knocked-down flat position and downwardly direct the bottom panels when the container is moved from a knocked-down flat position to an erected position.

In another aspect, a container formed from a blank of sheet material is provided. The container has automatically locking bottom panels. The container includes a pair of end walls, a pair of side walls and at least one corner wall interconnected along a plurality of fold lines, wherein the at least one corner wall extends between an adjacent end wall and side wall, a bottom wall includes a plurality of bottom panels. The plurality of bottom panels includes a pair of bottom end panels each extending from a bottom edge of each of the pair of end walls and a pair of bottom side panels each extending from a bottom edge of the pair of side walls. A first coupling tab is integral with one of the pair of bottom end panels, and a second coupling tab is integral with one of the pair of bottom side panels. The first coupling tab attaches to one of the pair of bottom side panels, and the second coupling tab attaches to one of the pair of bottom end panels. The coupling tabs are configured to upwardly direct the bottom panels when the container is moved from an erected position to a knocked-down flat position and downwardly direct the bottom panels when the container is moved from a knocked-down flat position to an erected position.

In still another aspect, a method of forming a container from a blank of sheet material is provided. The blank includes a pair of glue flaps, a pair of end panels, a pair of side panels, and at least one corner panel connected in series along a plurality of fold lines. The method includes rotating the side panels, end panels, and the at least one corner panel about respective fold lines toward an interior surface of the blank, coupling a first glue flap to a second glue flap to form a pair of side walls, a pair of end walls, and at least two corner walls, wherein a first corner wall includes the first and second glue flaps, rotating a first major bottom panel about a fold line toward an interior surface of a first side wall, and rotating a first minor bottom panel about a fold line toward an interior surface of a first end wall. An interior surface of the first minor bottom panel contacts an exterior surface of the first major bottom panel. The method also includes rotating a second major bottom panel about a fold line toward an interior surface of a second side wall, wherein an interior surface of the second major bottom panel contacts exterior surfaces of the first major and minor bottom panels, securing a coupling tab of the second major bottom panel to the first minor bottom panel, rotating a second minor bottom panel about a fold line toward an interior surface of a second end wall, wherein an interior surface of the second minor bottom panel contacts exterior surfaces of the major bottom panels, and securing a coupling tab of the second minor bottom panel to the first major bottom panel.

DETAILED DESCRIPTION OF THE INVENTION

The following detailed description illustrates the disclosure by way of example and not by way of limitation. The description clearly enables one skilled in the art to make and use the disclosure, describes several embodiments, adaptations, variations, alternatives, and use of the disclosure, including what is presently believed to be the best mode of carrying out the disclosure.

The present invention provides a stackable, collapsible container that includes bottom panels that allow the container to be collapsed and re-erected without breaking bonds between the bottom panels, and a method for constructing the container. The container is constructed from a blank of sheet material using a machine. In one embodiment, the container is fabricated from a cardboard material. The container, however, may be fabricated using any suitable material, and therefore is not limited to a specific type of material. In alternative embodiments, the container is fabricated using cardboard, plastic, fiberboard, paperboard, foamboard, corrugated paper, and/or any suitable material known to those skilled in the art and guided by the teachings herein provided.

In an example embodiment, the container includes at least one marking thereon including, without limitation, indicia that communicates the product, a manufacturer of the product and/or a seller of the product. For example, the marking may include printed text that indicates a product's name and briefly describes the product, logos and/or trademarks that indicate a manufacturer and/or seller of the product, and/or designs and/or ornamentation that attract attention. "Printing," "printed," and/or any other form of "print" as used herein may include, but is not limited to including, ink jet printing, laser printing, screen printing, giclée, pen and ink, painting, offset lithography, flexography, relief print, rotogravure, dye transfer, and/or any suitable printing technique known to those skilled in the art and guided by the teachings herein provided. In another embodiment, the container is void of markings, such as, without limitation, indicia that communicates the product, a manufacturer of the product and/or a seller of the product.

Figure 1:
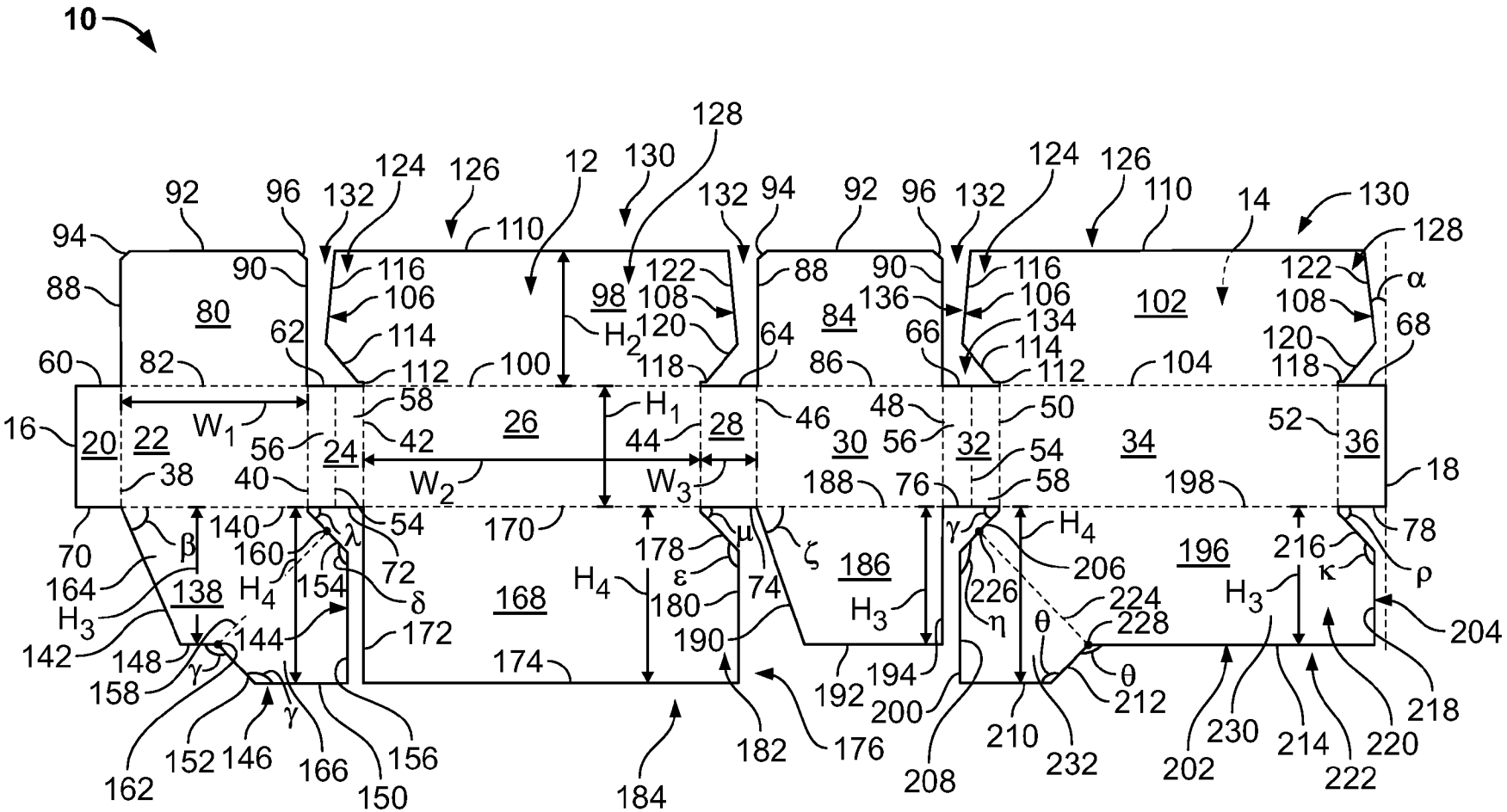
FIG. 1 is a top plan view of a blank of sheet material for constructing a container, according to a first embodiment of the present invention.

Referring now to the drawings, and more specifically to FIG. 1, which is a top plan view of a first embodiment of a blank 10 of sheet material. A container 400 (shown in FIGS. 3-7) is formed from blank 10. Blank 10 has a first or interior surface 12 and an opposing second or exterior surface 14. Further, blank 10 defines a leading edge 16 and an opposing trailing edge 18. In one embodiment, blank 10 includes, in series from leading edge 16 to trailing edge 18, a first glue flap 20, a first minor side panel 22, a first corner panel 24, a first major side panel 26, a second corner panel 28, a second minor side panel 30, a third corner panel 32, a second major side panel 34, and a second glue flap 36 coupled together along preformed, generally parallel, fold lines 38, 40, 42, 44, 46, 48, 50, and 52, respectively. More specifically, first glue flap 20 extends from first minor side panel 22 along fold line 38, first corner panel 24 extends from first minor side panel 22 along fold line 40, first major side panel 26 extends from first corner panel 24 along fold line 42, second corner panel 28 extends from first major side panel 26 along fold line 44, second minor side panel 30 extends from second corner panel 28 along fold line 46, third corner panel 32 extends from second minor side panel 30 along fold line 48, second major side panel 34 extends from third corner panel 32 along fold line 50, and second glue flap 36 extends from second major side panel 34 along fold line 52. Fold lines 38, 40, 42, 44, 46, 48, 50, and/or 52, as well as other fold lines and/or hinge lines described herein, may include any suitable line of weakening and/or line of separation known to those skilled in the art and guided by the teachings herein provided. Minor side panels 22 and 30 may be considered to be end panels, and major side panels 26 and 34 may be considered to be side panels.

In the exemplary embodiment, first glue flap 20, first minor side panel 22, first corner panel 24, first major side panel 26, second corner panel 28, second minor side panel 30, third corner panel 32, second major side panel 34, and second glue flap 36 have a height $H_1$. Minor side panels 22 and 30 have a first width $W_1$ and major side panels 26 and 34 have a second width $W_2$ that is wider than the first width $W_1$. Alternatively, minor side panels 22 and/or 30 and/or major side panels 26 and/or 34 are not equally dimensioned. Further, in the exemplary embodiment, corner panels 24, 28, and 32 and glue flaps 20 and 36 have a third width $W_3$ that is narrower than both the first width $W_1$ and the second width $W_2$. Alternatively, corner panels 24, 28, and 32 and glue flaps 20 and 36 are not equally dimensioned. In the exemplary embodiment, first corner panel 24 and third corner panel 32 each include a center fold line 54 that bisects the width of a respective corner panel 24 or 32 into a first portion 56 and a second portion 58. Moreover, first glue flap 20, first corner panel 24, second corner panel 28, third corner panel 32, and second glue flap 36 each include a top edge 60, 62, 64, 66, and 68, respectively, and a bottom edge 70, 72, 74, 76, and 78, respectively.

A first minor top panel 80 extends from first minor side panel 22 along a fold line 82, and a second minor top panel 84 extends from second minor side panel 30 along a fold line 86. First minor top panel 80 is substantially congruent with second minor top panel 84. Fold lines 82 and 86 are substantially collinear with top edges 60, 62, 64, 66, and 68 and define a top edge of a respective minor side panel 22 or 30. Each minor top panel 80 and 84 is substantially rectangular and includes a first side edge 88, a second side edge 90, and a free edge 92. First side edge 88 is substantially parallel to second side edge 90, and free edge 92 is substantially perpendicular to first and second side edges 88 and 90. Where first side edge 88 intersects free edge 92, an angled edge 94 is formed, and, where second side edge 90 intersects free edge 92, an angled edge 96 is formed. Angled edges 94 and 96 facilitate assembly of a container from blank 10. Alternatively, minor top panels 80 and/or 84 do not include angle edge 94 and/or 96. In the exemplary embodiment, first side edge 88 of first minor top panel 80 is substantially collinear with fold line 38, second side edge 90 of first minor top panel 80 is substantially collinear with fold line 40, first side edge 88 of second minor top panel 84 is substantially collinear with fold line 46, and second side edge 90 of second minor top panel 84 is substantially collinear with fold line 48.

A first major top panel 98 extends from first major side panel 26 along a fold line 100, and a second major top panel 102 extends from second major side panel 34 along a fold line 104. First major top panel 98 is substantially congruent with second major top panel 102. Fold lines 100 and 104 are substantially collinear with top edges 60, 62, 64, 66, and 68 and define a top edge of a respective major side panel 26 or 34. Each major top panel 98 and 102 includes a first side edge 106, a second side edge 108, and a free edge 110. Free edge 110 is generally perpendicular to first and second side edges 106 and 108. First side edge 106 defines a first slot 112, a first diverging diagonal edge 114, and a first gradually converging edge 116. Similarly, second side edge 108 defines a second slot 118, a second diverging diagonal edge 120, and a second gradually converging edge 122. "Diverging" and "converging" are defined with respect to side edges 106 and 108 in a direction toward free edge 110.

First diagonal edge 114 and first converging edge 116 define a first extension portion 124 extending from a first side region 126 of each major top panel 98 and 102, and second diagonal edge 120 and second converging edge 122 define a second extension portion 128 extending from a second side region 130 of each major top panel 98 and 102. More specifically, first extension portion 124 of first major top panel 98 extends from first side region 126 beyond fold line 42 and is adjacent to first corner panel 24 and first minor top panel 80, second extension portion 128 of first major top panel 98 extends from second side region 130 beyond fold line 44 and is adjacent to second corner panel 28 and second minor top panel 84, first extension panel 124 of second major top panel 102 extends from first side region 126 beyond fold line 50 and is adjacent to third corner panel 32 and second minor top panel 84, and second extension panel 128 of second major top panel 102 extends from second side region 130 beyond fold line 52 and is adjacent to second glue panel 36 and trailing edge 18. As such, extensions portions 124 and 128 extend above top edges 62, 64, 66, and 68 of adjacent corner panels 24, 28, and/or 32 and/or glue panel 36. Extension portion 124 and 128 may be considered to be corner portion extensions. Each diagonal edge 114 and 120 is configured to correspond to an angle of an adjacent corner wall 404, 408, 412, or 416 (shown in FIGS. 3-7) when container 400 is formed from blank 10. Each slot 112 and 118 facilitate folding of major top panels 98 and 102 to close container 400 formed from blank 10. More specifically, slots 112 and 118 enable top major panels 98 and 102 to be folded over minor top panels 80 and 84 to close container 400.

Each minor top panel 80 and 84 is separated from an adjacent major top panel 98 and 102 by a gap 132. Each gap 132 includes a generally triangular portion 134 and a diverging portion 136. Further, second converging edge 122 of second major top panel 102 is oriented with respect to trailing edge 18 such that second converging edge 122 of second major top panel 102 is at an acute angle a to trailing edge 18. Moreover, each top panel 80, 84, 98, and 102 has a height $H_2$.

A first minor bottom panel 138 extends from first minor side panel 22 along a fold line 140. Fold line 140 is substantially parallel to fold line 82 and defines a bottom edge of first minor side panel 22. First minor bottom panel 138 includes a first side edge 142, a second side edge 144, and a free edge 146. First side edge 142 extends from an intersection of fold lines 38 and 140 such that first side edge 142 is at an acute angle $\beta$ to fold line 140. Free edge 146 includes a first bottom edge 148 and a second bottom edge 150 that are connected by a bottom diagonal edge 152. First and second bottom edges 148 and 150 and fold line 140 are substantially parallel, and bottom diagonal edge 152 is at an oblique angle $\gamma$ to first and second bottom edges 148 and 150. First bottom edge 148 is connected to first side edge 142. First bottom edge 148 is spaced a height $H_3$ from fold line 140, and second bottom edge 150 is spaced a height $H_4$ from fold line 140, wherein height $H_4$ is larger than height $H_3$. Further, height $H_3$ is substantially equal to height $H_2$. Alternatively, height $H_2$ and height $H_3$ may be other than equal. In the exemplary embodiment, second side edge 144 includes a first portion 154 and a second portion 156. First portion 154 extends between fold line 140 and second portion 156 and is at an oblique angle $\delta$ to second portion 156. As such, first portion 154 is at an acute angle $\lambda$ to bottom edge 72 of first corner panel 24. Second portion 156 connects to second bottom edge 150 at a substantially right angle. Dimensions of first portion 154, second portion 156, and/or angle $\delta$ and/or angle $\lambda$ are selected based on the configuration of a first corner wall 404 of container 400.

Furthermore, a fold line 158 extends from a point 160 substantially bisecting first portion 154 to a point 162 at which first bottom edge 148 intersects with diagonal bottom edge 152 such that fold line 158 is substantially perpendicular to first portion 154. Fold line 158 divides first minor bottom panel 138 into a base panel 164 and a first coupling tab 166, wherein first coupling tab 166 extends from base panel 164 along fold line 158. First coupling tab 166 is defined by fold line 158, diagonal bottom edge 152, second bottom edge 150, second portion 156, and a part of first portion 154. At least a portion of first coupling tab 166 is adjacent to first corner panel 24. At such, at least a portion of first coupling tab 166 extends beneath bottom edge 72 of first corner panel 24. Further, base panel 164 is defined by first bottom edge 148, first side edge 142, fold line 140, the other part of first portion 154, and fold line 158.

A first major bottom panel 168 extends from first major side panel 26 along a fold line 170. Fold line 170 is substantially parallel to fold line 100 and defines a bottom edge of first major side panel 26. First major bottom panel 168 includes a first side edge 172, a free edge 174, and a second side edge 176. First side edge 172 extends from an intersection of fold lines 42 and 170 such that first side edge 172 is substantially collinear with fold line 42. Free edge 174 is connected to first side edge 172 at a substantially right angle and is spaced height $H_4$ from fold line 170. Second side edge 176 includes a first portion 178 and a second portion 180.

First portion 178 extends between fold line 170 and second portion 180 and is at an oblique angle $\epsilon$ to second portion 180. As such, first portion 178 is at an acute angle $\mu$ to bottom edge 74 of second corner panel 28. Second portion 180 connects to free edge 174 at a substantially right angle. Dimensions of first portion 178, second portion 180, and/or angle $\epsilon$ and/or angle $\mu$ are selected based on the configuration of a second corner wall 408 of container 400. Second side edge 180 defines an extension portion 182 extending from a second side region 184 of first major bottom panel 168. Extension portion 182 of first major bottom panel 168 extends from second side region 184 beyond fold line 44 and is adjacent to second corner panel 28. As such, extension portion 182 is beneath bottom edge 74 of second corner panel 28.

A second minor bottom panel 186 extends from second minor side panel 30 along a fold line 188. Fold line 188 is substantially parallel to fold line 86 and defines a bottom edge of second minor side panel 30. Second minor bottom panel 186 includes a first side edge 190, a free edge 192, and a second side edge 194. First side edge 190 extends from an intersection of fold lines 46 and 188 such that first side edge 190 is at an acute angle $\zeta$ to fold line 188. Angle $\zeta$ is substantially equal to angle $\beta$. Alternatively, angle $\zeta$ is other than equal to angle $\beta$. In the exemplary embodiment, free edge 192 is substantially parallel to fold line 188 and is spaced height $H_3$ from fold line 188. Free edge 192 is connected to first side edge 190. Second side edge 194 is connected to free edge 192 at a substantially right angle and is substantially collinear with fold line 48.

A second major bottom panel 196 extends from second major side panel 34 along a fold line 198. Fold line 198 is substantially parallel to fold line 104 and defines a bottom edge of second major side panel 34. Fold lines 140, 170, 188, and 198 are substantially collinear with bottom edges 70, 72, 74, 76, and 78. Second major bottom panel 196 includes a first side edge 200, a free edge 202, and a second side edge 204. First side edge 200 includes a first portion 206 and a second portion 208. Free edge 202 includes a first bottom edge 210, a bottom diagonal edge 212, and a second bottom edge 214. Second side edge 204 includes a third portion 216 and a fourth portion 218.

First portion 206 of first side edge 200 extends between fold line 198 and second portion 208 and is at an oblique angle $\eta$ to second portion 208. As such, first portion 206 is at an acute angle $\nu$ to bottom edge 76 of third corner panel 32. Dimensions of first portion 206, second portion 208, and/or angle $\eta$ and/or angle $\nu$ are selected based on the configuration of a third corner wall 412 of container 400. First and second bottom edges 210 and 214 of free edge 202 and fold line 198 are substantially parallel, and bottom diagonal edge 212 is at an oblique angle $\theta$ to first and second bottom edges 210 and 214. Angle $\theta$ is substantially equal to angle $\gamma$. Alternatively, angle $\theta$ is other than equal to angle $\gamma$ depending on the configuration of corner walls 404, 408, 412, and/or 416. In the exemplary embodiment, first bottom edge 210 is connected to second portion 208 of first side edge 200 at a substantially right angle. First bottom edge 210 is spaced height $H_4$ from fold line 198, and second bottom edge 214 is spaced height $H_3$ from fold line 198.

Third portion 216 of second side edge 204 extends between fold line 198 and fourth portion 218 and is at an oblique angle $\kappa$ to fourth portion 218. As such, third portion 216 is at an acute angle $\rho$ to bottom edge 78 of second glue flap 36. Fourth portion 218 connects to free edge 202 at a substantially right angle. Dimensions of third portion 216, fourth portion 218, and/or angle $\kappa$ and/or angle $\rho$ are selected based on the configuration of a fourth corner wall 416 of container 400. Second side edge 204 defines an extension portion 220 along a second side region 222 of second major bottom panel 196. Extension portion 220 of second major bottom panel 196 extends from second side region 222 beyond fold line 52 and is adjacent to second glue flap 36. As such, extension portion 220 extends beneath bottom edge 70 of second glue flap 36.

Furthermore, a fold line 224 extends from a point 226 substantially bisecting first portion 206 of first side edge 200 to a point 228 at which second bottom edge 214 intersects with diagonal bottom edge 212 such that fold line 224 is substantially perpendicular to first portion 206. Fold line 224 divides second major bottom panel 196 into a base panel 230 and a second coupling tab 232, wherein second coupling tab 232 extends from base panel 230 along fold line 224. Second coupling tab 232 is defined by fold line 224, diagonal bottom edge 212, first bottom edge 210, second portion 208, and a part of first portion 206. At least a portion of second coupling tab 232 is adjacent to third corner panel 32. As such, at least a portion of second coupling tab 232 extends beneath bottom edge 76 of third corner panel 32. Further, base panel 230 is defined by second bottom edge 214, second side edge 204, fold line 198, the other part of first portion 206, and fold line 224.

Angles $\delta$, $\epsilon$, $\eta$, and $\kappa$ are substantially equal and angles $\lambda$, $\mu$, $\nu$, and $\rho$ are substantially equal because at least first glue flap 20, first corner panel 24, second corner panel 28, third corner panel 32, and second glue flap 36 are equally dimensioned. When first glue flap 20, first corner panel 24, second corner panel 28, third corner panel 32, and/or second glue flap 36 are not equally dimensioned, angles $\delta$, $\epsilon$, $\eta$, and/or $\kappa$ are other than equal and/or angles $\lambda$, $\mu$, $\nu$, and/or $\rho$ are other than equal. Further, first coupling tab 166 is adjacent first major bottom panel 168, extension portion 182 of first major bottom panel 168 is adjacent second minor bottom panel 186, second coupling tab 232 is adjacent second minor bottom panel 186, and extension portion 220 of second major bottom panel 196 is adjacent trailing edge 18. Moreover, the portion of first coupling tab 166 that extends beneath bottom edge 72 of first corner panel 24, extension portion 182, the portion of the second coupling tab 232 that extends beneath bottom edge 76 of third corner panel, and extension portion 220 are considered to be corner portion extensions.

Figure 2:
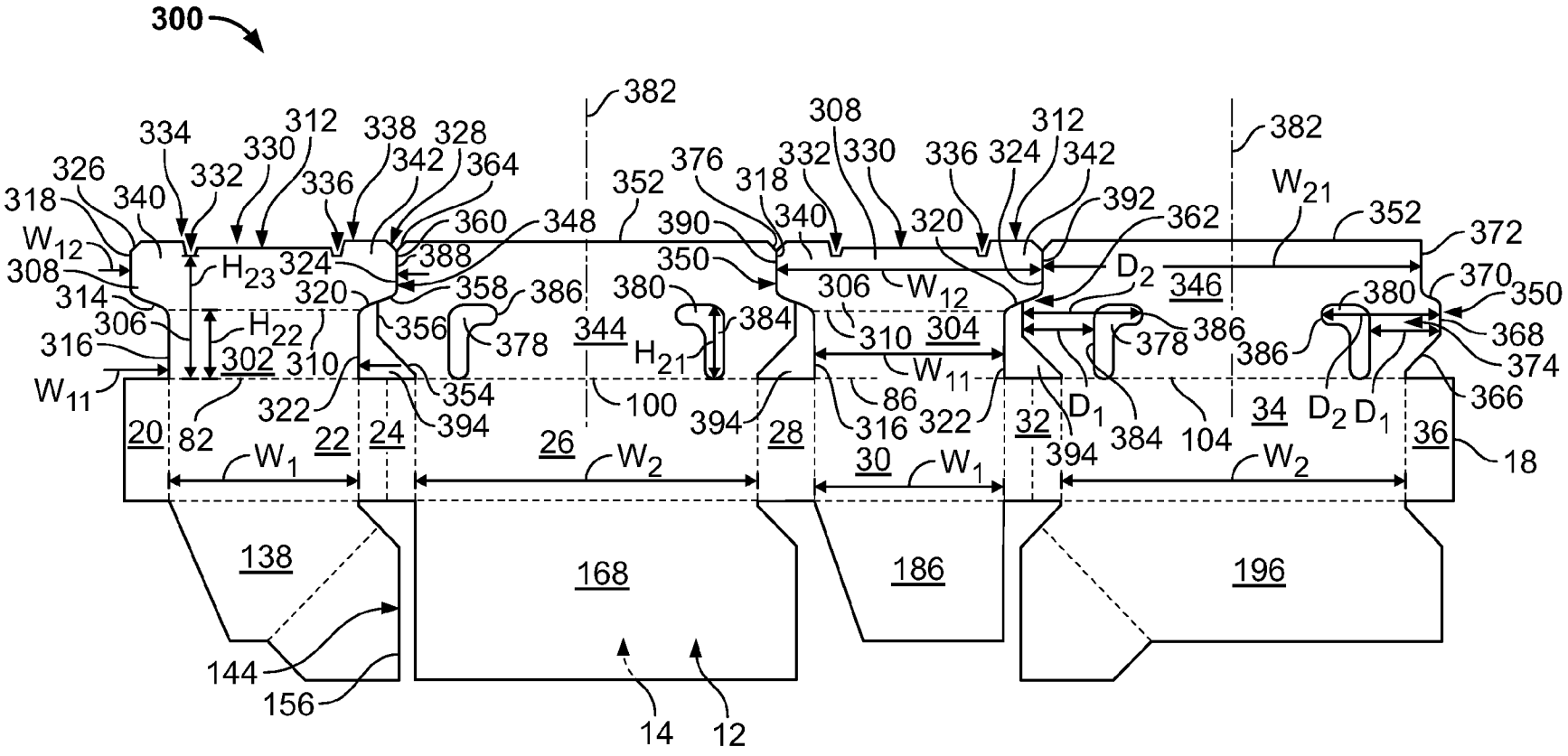
FIG. 2 is a top plan view of a blank of sheet material for constructing a container, according to a first alternative embodiment of the present invention.

FIG. 2 is a top plan view of a blank 300 of sheet material for constructing a container according to a first alternative embodiment of the present invention. Blank 300 is essentially similar to blank 10 (shown in FIG. 1) and, as such, similar components are labeled with similar references. More specifically, blank 300 includes an alternative embodiment the top panels.

A first minor top panel 302 extends from first minor side panel 22 along fold line 82, and a second minor top panel 304 extends from second minor side panel 30 along fold line 86. First minor top panel 302 is substantially congruent to second minor top panel 304. Each minor top panel 302 and 304 includes a first portion 306 and a second portion 308 that are connected by a fold line 310. Fold line 310 is substantially parallel to fold line 82 or 86 and facilitates closing top panels 302 and 304, as described below. First portion 306 is substantially rectangular and extends between fold line 82 or 86 and fold line 310. First portion 306 has a width $W_{11}$ that is substantially equal to width $W_1$. Second portion 308 extends between fold line 310 and a free edge 312 of each minor top panel 302 and 304. Second portion 308 has a width $W_{12}$ that is wider than width $W_{11}$ such that second portion 308 is wider than first portion 306.

A first diagonal side edge 314 extends between a first side edge 316 of first portion 306 and a first side edge 318 of second portion 308. Similarly, a second diagonal side edge 320 extends between a second side edge 322 of first portion 306 and a second side edge 324 of second portion 308. Second side edge 324 of first minor top panel second portion 308 is substantially collinear with second side edge second portion 156 of first minor bottom panel 138. Second portion first side edge 318 connects to free edge 312 at a first angled edge 326, and second portion second side edge 324 connects to free edge 312 at a second angled edge 328. Alternatively, minor top panels 302 and/or 304 do not include angled edges 326 and/or 328. In the exemplary embodiment, free edge 312 includes a recess 330 extending along the width of second portion 308. A first notch 332 is defined at a first end 334 of recess 330, and a second notch 336 is defined at a second end 338 of recess 330. A first interlock tab 340 is defined between first side edge 318 and first notch 332, and a second interlock tab 342 is defined between second side edge 324 and second notch 336.

A first major top panel 344 extends from first major side panel 26 along fold line 100, and a second major top panel 346 extends from second major side panel 34 along fold line 104. First major top panel 344 is substantially congruent to second major top panel 346. Each major top panel 344 and 346 includes a first side edge 348, a second side edge 350, and a free edge 352. Free edge 352 is substantially parallel to a respective fold line 100 or 104. First side edge 348 includes a first diagonal portion 354, a first lateral portion 356, a second diagonal portion 358, and a second lateral portion 360. First diagonal portion 354 extends from an adjacent fold line 100 or 104 toward an adjacent minor top panel 302 or 304. First diagonal portion 354 connects to first lateral portion 356, which is substantially perpendicular to free edge 352. Opposing first diagonal portion 354, first lateral portion 356 is connected to second diagonal portion 358. Second diagonal portion 358 slopes away from an adjacent minor top panel 302 or 304 and connects to second lateral portion 360. As such, a first projection 362 is defined by second diagonal portion 358, first lateral portion 356, and a portion of first diagonal portion 354. First projections 362 extend above top edges 62 and 66 of corner panels 24 and 32. Second lateral portion 360 is substantially perpendicular to free edge 352 and connects to free edge 352 at an angled edge 364. Alternatively, major top panel 344 and/or 346 does not include angled edge 364.

In the exemplary embodiment, second side edge 350 includes a first diagonal portion 366, a first lateral portion 368, a second diagonal portion 370, and a second lateral portion 372. Further, each first diagonal portion 354 and 366 is configured to correspond to an angle of an adjacent corner wall 404, 408, 412, or 416 (shown in FIGS. 3-7) when container 400 is formed from blank 300. First diagonal portion 366 extends from an adjacent fold line 100 or 104 toward second minor top panel 304 and trailing edge 18, respectively. First diagonal portion 366 connects to first lateral portion 368, which is substantially perpendicular to free edge 352. Opposing first diagonal portion 366, first lateral portion 368 is connected to second diagonal portion 370. Second diagonal portion 370 slopes away from second minor top panel 304 or trailing edge 18, respectively, and connects to second lateral portion 372. As such, a second projection 374 is defined by second diagonal portion 370, first lateral portion 368, and a portion of first diagonal portion 366. Second projections 374 extend above top edges 64 and 68 of corner panel 28 and glue flap 36, respectively. Projections 362 and 374 may be considered to be corner portion extensions. Second lateral portion 372 is substantially perpendicular to free edge 372 and connects with free edge 352 at an angled edge 376. Alternatively, major top panel 344 and/or 346 does not include angled edge 376. In the exemplary embodiment, a width $W_{21}$ is measured between second lateral portions 360 and 372. Width $W_{21}$ is larger than width $W_2$.

Each major top panel 344 and 346 includes a first L-shaped slot 378 and a second L-shaped slot 380. First and second slots 378 and 380 are adjacent to, and in contact with, a respective fold line 100 or 104. Slots 378 and 380 are symmetrically located with respect to a centerline 382 of a respective major top panel 344 or 346. More specifically, second slot 380 mirrors first slot 378 with respect to centerline 382. A height $H_{21}$ of each slot 378 and 380 is larger than a height $H_{22}$ of first portion 306 of minor top panels 302 and 304. Further, an outer edge 384 of each slot 378 and 380 is substantially perpendicular to an adjacent fold line 100 or 104 and is spaced a distance $D_1$ from an adjacent side edge first lateral portion 356 or 368. Distance $D_1$ is substantially equal to height $H_{22}$. An inner edge 386 of each slot 378 and 380 is spaced a distance $D_2$ from an adjacent side edge first lateral portion 356 or 368. Distance $D_2$ is substantially equal to a height $H_{23}$ that is measured between free edge notches 332 and 336 of minor top panels 302 and 304 and a respective fold line 82 or 86.

Each minor top panel 302 and 304 is adjacent to at least one major top panel 344 and/or 346. More specifically, a first cut line 388 between first minor top panel 302 and first major top panel 344 defines second portion second side edge 324 of minor top panel 302, a part of second diagonal side edge 320 of minor top panel 302, first side edge second diagonal portion 358 of major top panel 344, and first side edge second lateral portion 360 of major top panel 344. A second cut line 390 between first major top panel 344 and second minor top panel 304 defines second portion first side edge 318 of minor top panel 304, a part of first diagonal side edge 314 of minor top panel 304, second side edge second diagonal portion 370 of major top panel 344, and second side edge second lateral portion 372 of major top panel 344. A third cut line 392 between second minor top panel 304 and second major top panel 346 defines second portion second side edge 324 of minor top panel 304, a part of second diagonal side edge 320 of minor top panel 304, first side edge second diagonal portion 358 of major top panel 346, and first side edge second lateral portion 318 of major top panel 346. An opening 394 is defined by the other part of minor top panel diagonal edge 314 or 320, first portion side edge 316 or 322, first diagonal edge 354 or 366, and first lateral edge 356 or 368.

Figure 3:
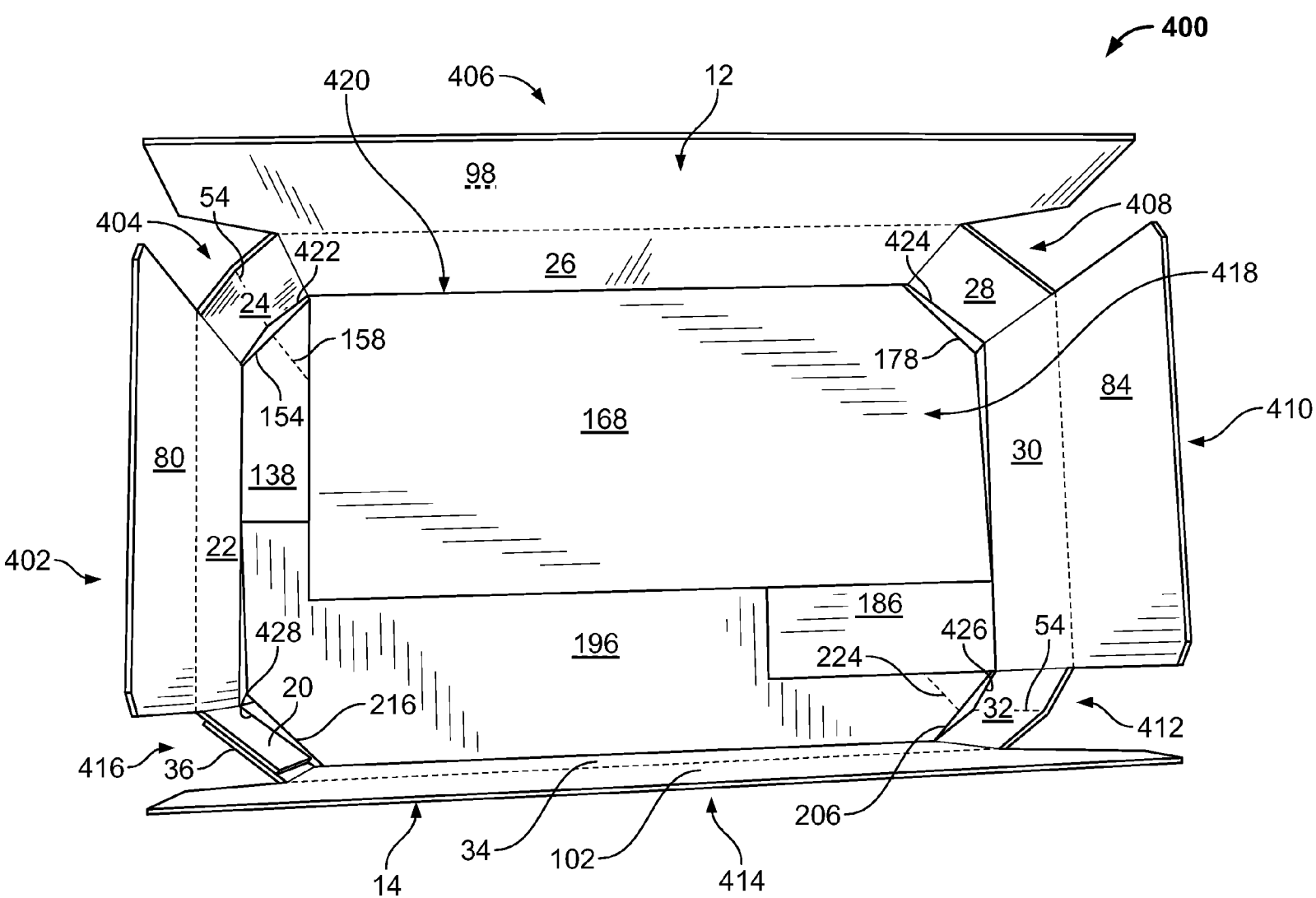
FIG. 3 is a top view of a container formed from the blank shown in FIG. 1.
Figure 4:
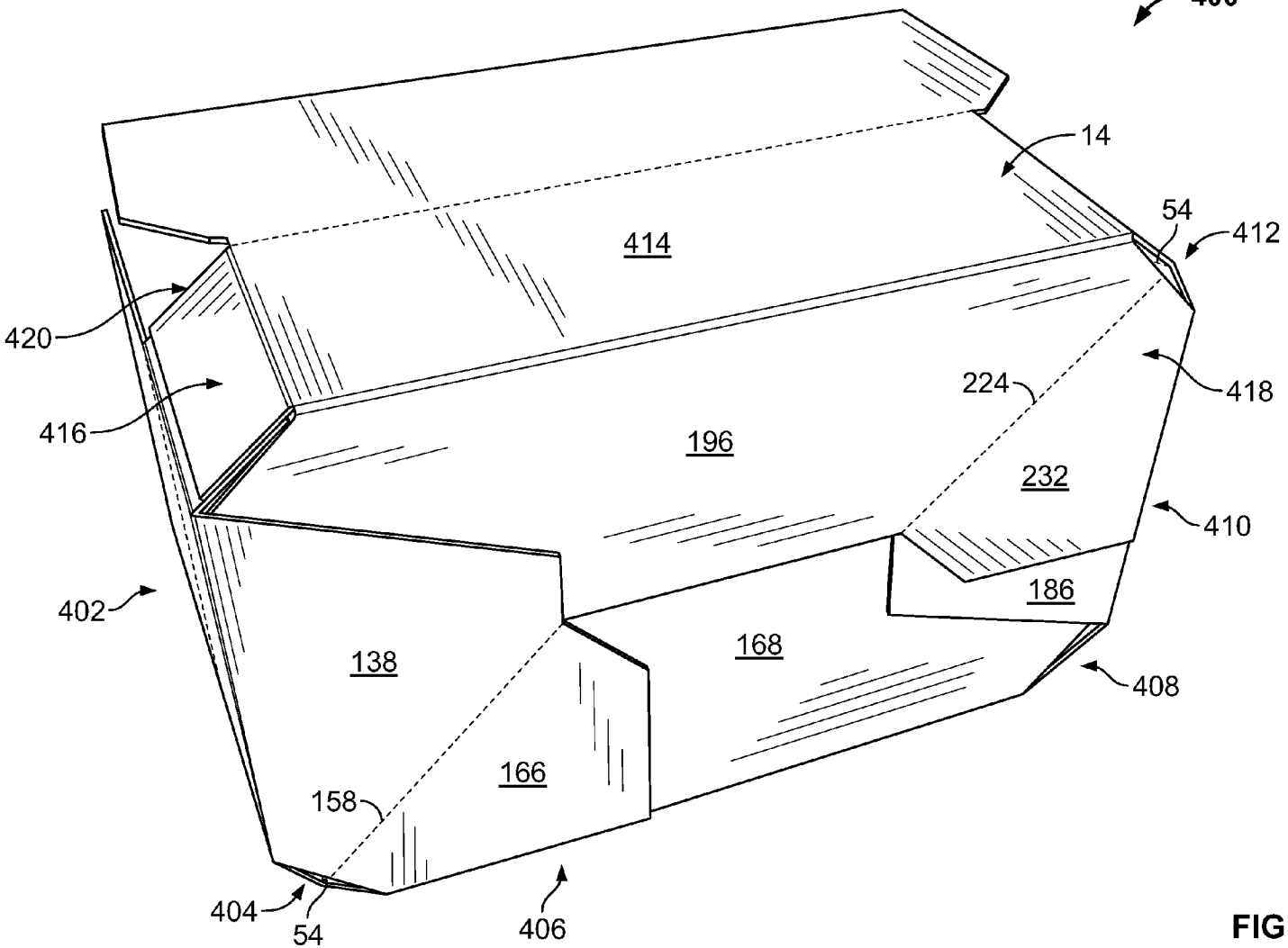
FIG. 4 is a bottom perspective view of a container formed from the blank shown in FIG. 1.
Figure 5:
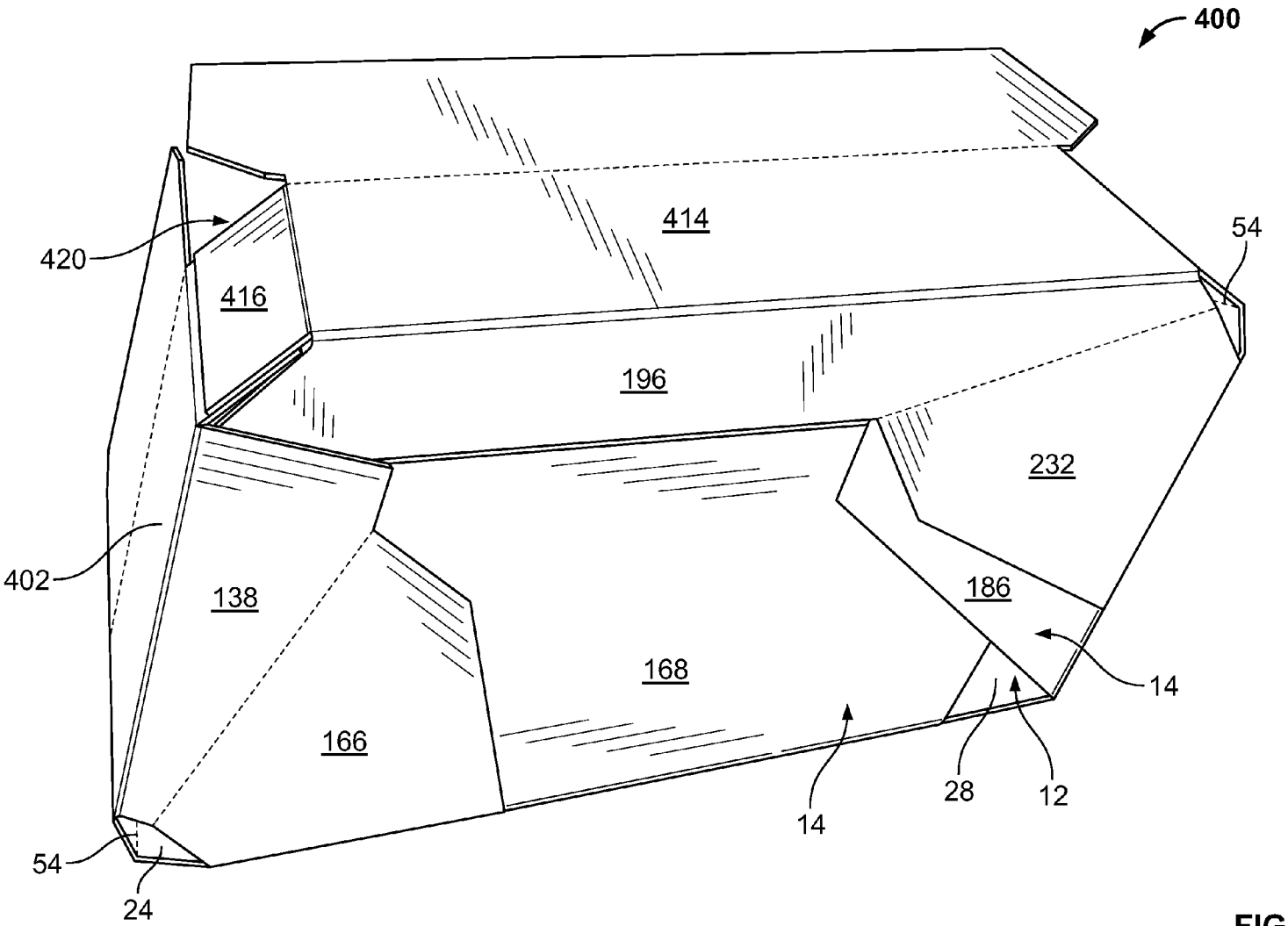
FIG. 5 is a bottom perspective view of a partially collapsed container formed from the blank shown in FIG. 1.
Figure 6:
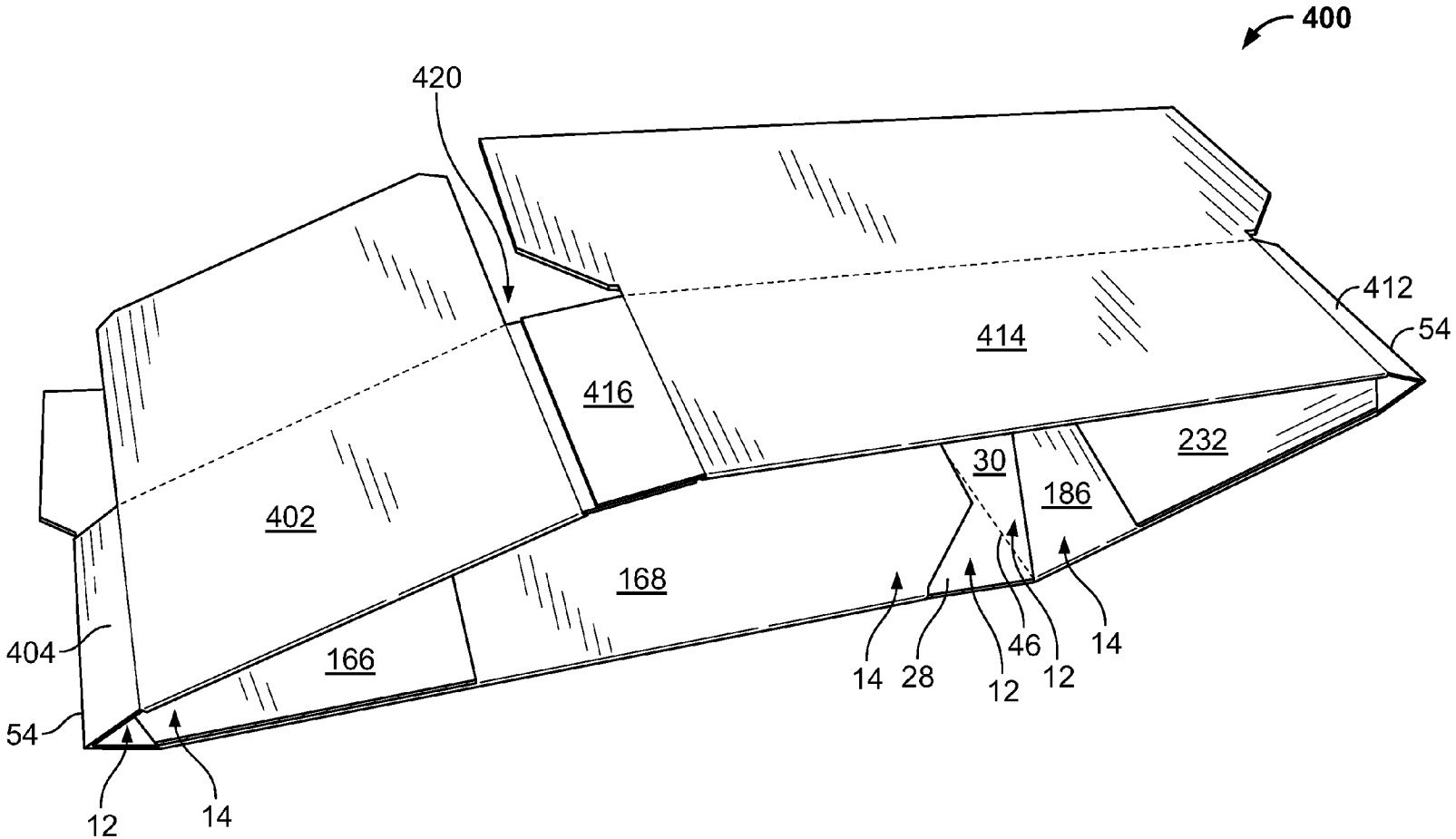
FIGS. 6 is a side perspective view of a partially collapsed container formed from the blank shown in FIG. 1.
Figure 7:
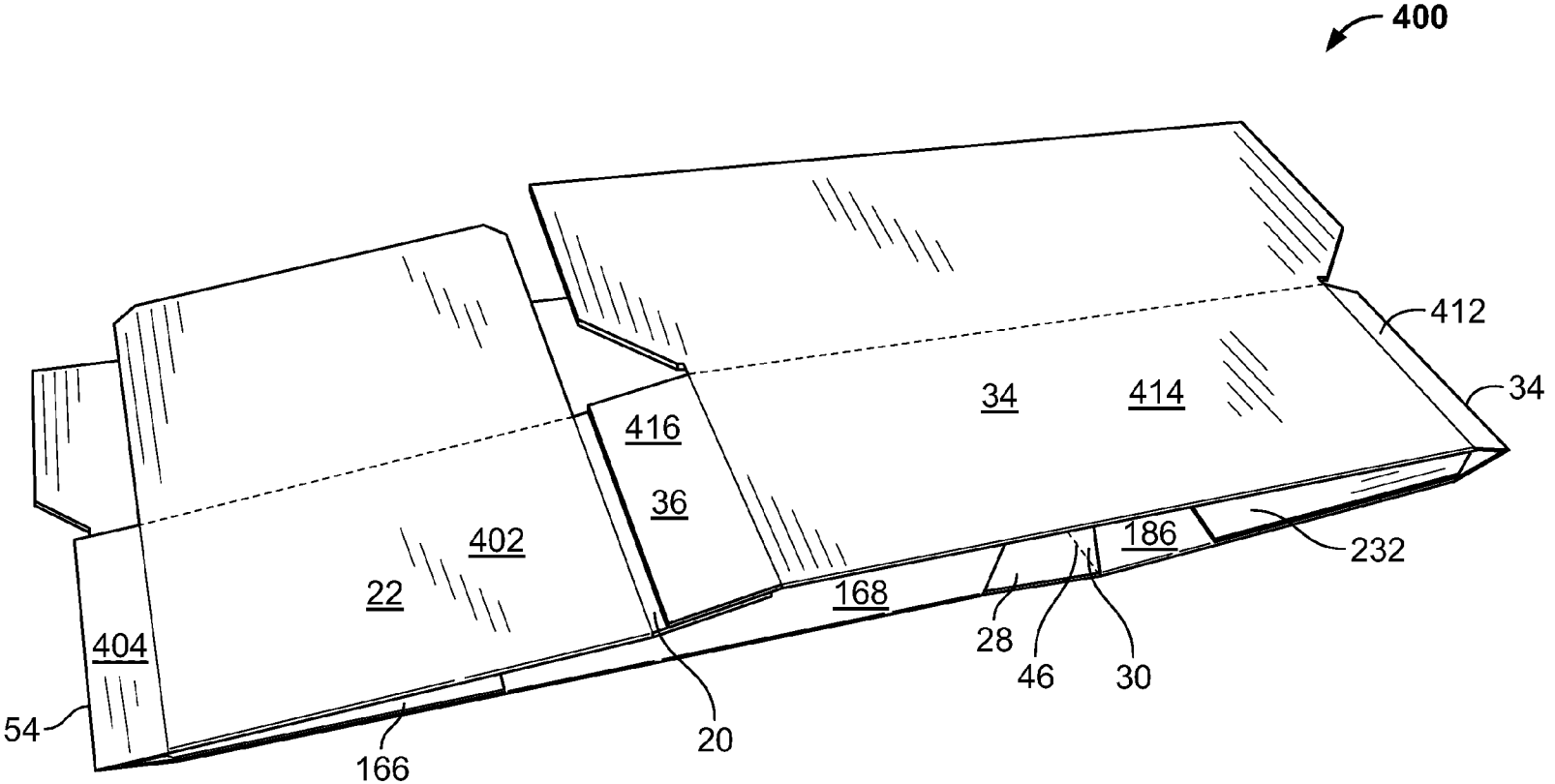
FIGS. 7 is a side perspective view of a collapsed container formed from the blank shown in FIG. 1.

FIG. 3 is a top view of a container 400 formed from blank 10. FIG. 4 is a bottom perspective view of container 400. FIG. 5 is a bottom perspective view of container 400 that is partially collapsed. FIG. 6 is a side perspective view of container 400 that is partially collapsed. FIG. 7 is a side perspective view of container 400 that is collapsed. Although that stages of collapsing container 400 are shown as discreet stages, it will be understood that collapse and/or erection of container 400 is a substantially continuous process.

Referring to FIGS. 1-4, to form container 400 from blank 10 and/or 300, side panels 22, 26, 30, and 34, corner panels 24, 28, and 32, and glue flaps 20 and 36 are rotated about respective fold lines 38, 40, 42, 44, 46, 48, 50, and 52 toward interior surface 12. First glue flap 20 is secured to second glue flap 36 using adhesive, tape, bonding agent, and/or any other suitable material. As such, a bond is formed between first and second glue flaps 20 and 36. Exterior surface 14 of first glue flap 20 is secured to interior surface 12 of second glue flap 36 such that trailing edge 18 is substantially aligned with fold line 38 and leading edge 16 is substantially aligned with fold line 52. Alternatively, interior surface 12 of first glue flap 20 is secured to exterior surface 14 of second glue flap 36.

In the exemplary embodiment, first minor side panel 22 forms a first minor side wall 402, first corner panel 24 forms a first corner wall 404, first major side panel 26 forms a first major side wall 406, second corner panel 28 forms a second corner wall 408, second minor side panel 30 forms a second minor side wall 410, third corner panel 32 forms a third corner wall 412, second major side panel 34 forms a second major side wall 414, and first and second glue flaps 20 and 36 form a fourth corner wall 416. Major side walls 406 and 414 are substantially parallel, minor side walls 402 and 410 are substantially parallel, first and third corner walls 404 and 412 are substantially parallel, and second and fourth corner walls 408 and 416 are substantially parallel. Minor side walls 402 and 410 may be considered to be end walls, and major side walls 406 and 414 may be considered to be side walls.

First major bottom panel 168 is rotated about fold line 170 toward interior surface 12 to be substantially perpendicular to first major side wall 406. Second minor bottom panel 186 is rotated about fold line 188 toward interior surface 12 to be substantially perpendicular to second minor side wall 410. Interior surface 12 of second minor bottom panel 186 is adjacent exterior surface 14 of first major bottom panel 168. Second major bottom panel 196 is rotated about fold line 198 toward interior surface 12 to be substantially perpendicular to second major side wall 414. Interior surface 12 of second major bottom panel 196 is adjacent exterior surface 14 of first major bottom panel 168 and second minor bottom panel 186. Interior surface 12 of second coupling tab 232 is secured and/or bonded to exterior surface 14 of second minor bottom panel 186 using adhesive, tape, and/or any other suitable bonding material. As such, a bond is formed between second coupling tab 232 and/or second major bottom panel 196 and second minor bottom panel 186.

First minor bottom panel 138 is rotated about fold line 140 toward interior surface 12 to be substantially perpendicular to first minor side wall 402. Interior surface 12 of first minor bottom panel 138 is adjacent exterior surface 14 of major bottom panels 168 and 196. Interior surface 12 of first coupling tab 166 is secured and/or bonded to exterior surface 14 of first major bottom panel 168 using adhesive, tape, and/or any other suitable bonding material. As such, a bond is formed between first major and minor bottom panels 168 and 138. Bottom panels 138, 168, 186, and 196, including coupling tabs 166 and 232, form a bottom wall 418. Bottom wall 418 and side and corner walls 402, 404, 406, 408, 410, 412, 414, and 416 define a cavity 420 of container 400. When bottom wall 418 and side and corner walls 402, 404, 406, 408, 410, 412, 414, and 416 are formed without forming a top wall, container 400 is considered to be in an open configuration.

Further, when bottom wall 418 is formed, second side edge first potion 154 of first minor bottom panel 138 is adjacent a bottom edge 422 of first corner wall 404, second side edge first portion 178 of first major bottom panel 168 is adjacent a bottom edge 424 of second corner wall 408, first side edge first portion 206 of second major bottom panel 196 is adjacent a bottom edge 426 of third corner wall 412, and second side edge third portion 216 of second major bottom panel 196 is adjacent a bottom edge 428 of fourth corner wall 416.

Referring to FIG. 1, to close container 400 formed from blank 10, minor top panels 80 and 84 are rotated about a respective fold line 82 or 86 toward cavity 420 such that minor top panels 80 and 84 are substantially parallel to bottom wall 418. Major top panels 98 and 102 are rotated about a respective fold line 100 or 104 toward cavity 420 such that major top panels 98 and 102 are substantially parallel to bottom wall 418. Further, interior surface 12 of major top panels 98 and 102 are adjacent exterior surface 14 of minor top panels 80 and 84. Top panels 80, 84, 98, and 102 form the top wall. Major top panels 98 and/or 102 may be secured at least to minor top panels 80 and/or 94 using adhesive, tape, bonding material, and/or any other suitable substance and/or material.

Referring to FIG. 2, to close container 400 formed from blank 300, major top panels 344 and 346 are rotated about a respective fold line 100 or 104 toward cavity 420 such that major top panels 344 and 346 are substantially parallel to bottom wall 418. Minor top panels 302 and 304 are rotated about a respective fold line 82 or 86 toward cavity 420 such that minor top panels 302 and 304 are substantially parallel to bottom wall 418. Further, interior surface 12 of minor top panels 302 and 304 are adjacent exterior surface 14 of major top panels 344 and 346. Top panels 302, 304, 344, and 346 form the top wall. Minor top panels 302 and/or 304 may be secured to major top panels 344 and/or 346 by inserting interlock tabs 340 and 342 within an adjacent slot 378 or 380. More specifically, first minor top panel second portion 308 may be slightly rotated about fold line 310 toward first portion 306, and second minor top panel second portion 308 may be slightly rotated about fold line 310 toward first portion 306 to facilitate aligning interlock tabs 340 and 342 with an adjacent slot 378 or 380. First interlock tab 340 of first minor top panel 302 is inserted into second slot 380 of second major top panel 346, second interlock tab 342 of first minor top panel 302 is inserted into first slot 378 of first major top panel 344, first interlock tab 340 of second minor top panel 304 is inserted into second slot 380 of first major top panel 344, and second interlock tab 342 of second minor top panel 304 is inserted into first slot 378 of second major top panel 346. Minor top panels 302 and/or 304 may be further secured to major top panels 344 and/or 346 using adhesive, tape, bonding material, and/or any other suitable substance and/or material.

Referring to FIGS. 1 and 5-7, to collapse container 400, major bottom panels 168 and 196 are pushed into cavity 420 toward interior surface 12 of side and corner walls 402, 404, 406, 408, 410, 412, 414, and 416. Coupling tabs 166 and 232 pull minor bottom panels 138 and 186 into cavity 420. Further, coupling tabs 166 and 232 rotate about a respective fold line 158 or 224 toward exterior surface 14 of an adjacent base panel 164 or 230. As bottom panels 138, 168, 186, and 196 are rotated into cavity 420, first minor side wall 402 is rotated about first corner panel fold line 54 toward first major side wall 406. Similarly, second minor side wall 410 is rotated about third corner panel fold line 54 toward second major side wall 414. As such, bottom wall 418 collapsed within cavity 420 and is received within side and corner walls 402, 404, 406, 408, 410, 412, 414, and 416. As such, coupling tabs 166 and 232 are configured to upwardly direct bottom panels 138, 168, 186, and 196 into cavity 420 when container 400 is moved from the open configuration to a collapsed configuration.

When bottom panels 138, 168, 186, and 196 are fully rotated into cavity 420 and received within side and corner walls 402, 404, 406, 408, 410, 412, 414, and 416, bottom panels 138, 168, 186, and 196 are substantially parallel to side and corner walls 402, 404, 406, 408, 410, 412, 414, and 416. Further, interior surfaces 12 of first and second portions 56 and 58 of first and third corner panels 24 and 32 are adjacent. Interior surface 12 of first minor bottom panel base panel 164 is adjacent interior surface 12 of first minor side wall 402, interior surface 12 of first major bottom panel 168 is adjacent interior surface 12 of first major side wall 406 and second corner wall 408, interior surface 12 of second minor bottom panel 186 is adjacent interior surface 12 of second minor side wall 410, and interior surface 12 of second major bottom panel base panel 230 is adjacent interior surface 12 of second major side wall 414 and fourth corner wall 416. Accordingly, container 400 may be collapsed without breaking the bonds between first major and minor bottom panels 138 and 168 and/or between second major and minor panels 186 and 196. Further, bottom panels 138, 168, 186, and 196 are received within side and corner walls 402, 404, 406, 408, 410, 412, 414, and 416 to facilitate reducing the area occupied by container 400 when container 400 is collapsed. When container 400 is in such a configuration, container 400 is considered to be in a knocked-down and/or collapsed configuration.

To erect container 400 from the collapsed configuration, major side panels 26 and 34 are pulled apart and/or away from each other, which cause minor side panels 22 and 30 to move outwards. At least a portion of second minor bottom panel 186 slides under first major bottom panel 168 such that interior surface 12 of second minor bottom panel 186 contacts exterior surface 14 of first major bottom panel 168. Similarly, at least a portion of base panel 164 of first minor bottom panel 138 slides under second major bottom panel 196 such that interior surface 12 of base panel 164 contacts exterior surface 14 of second major bottom panel 196. As major side panels 26 and 34 continue to move apart, at least a portion of base panel 230 of second major bottom panel 196 slides under first major bottom panel 168 such that interior surface 12 of base panel 230 contacts exterior surface 14 of first major bottom panel 168. While major side panels 26 and 34 are moved apart, first and second portions 56 and 58 of first corner panel 24 rotate apart about fold line 54, and first and second portions 56 and 58 of third corner panel 32 rotate apart about fold line 54. Further, first coupling tab 166 rotates about fold line 158 away from first minor bottom panel base panel 164, and second coupling tab 232 rotates about fold line 224 away from second major bottom panel base panel 230. As such, coupling tabs 166 and 232 are configured to downwardly direct bottom panels 138, 168, 186, and 196 into cavity 420 when container 400 is moved from the collapsed configuration to an erect configuration.

As container 400 is erected from the collapsed configuration, bottom panels 138, 168, 186, and 196 automatically lock into the positions that bottom panels 138, 168, 186, and 196 were in before container 400 was collapsed, without further manipulation by a user. As such, bottom panels 138, 168, 186, and 196 may be referred to as "automatically locking" bottom panels. When container 400 is substantially fully erected, bottom panels 138, 168, 186, and 196 are substantially coplanar and form bottom wall 418. Accordingly, container 400 is in the open configuration. As such, container 400 may be erected from the collapsed configuration without any additional adhesive and/or tape being applied to bottom panels 138, 168, 186, and/or 196. Container 400 may be closed as described above.

The above-described blank and container formed from the blank includes eight sides to provided added compression strength as compared to containers having less than eight sides, such as containers having four sides. Furthermore, the above-described bottom panels provide an automatically locking bottom wall that allows a user to collapse the container and then re-erect the container into a fully functional container without the use of addition adhesive and/or tape. As such, a user may collapse the container for storage and then re-erect the container for re-use more quickly and easily as compared to containers that require that bonds between panels be broken for collapse and re-bonded for re-use. Moreover, the above-described blank may be formed on a known blank-forming machine.

Exemplary embodiments of a container having an automatically locking bottom and blanks for making the same are described above in detail. The blanks and the container are not limited to the specific embodiments described herein, but rather, components of the blanks and/or the container may be utilized independently and separately from other components described herein. For example, the bottom panels of the blanks may also be used in combination with other type of container, and is not limited to practice with only the container as described herein. Rather, the exemplary embodiment can be implemented and utilized in connection with many other container applications.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A blank of sheet material for forming a container including automatically locking bottom panels, said blank comprising:

a pair of end panels, a pair of side panels and at least one corner panel interconnected to form a pair of opposing end walls, a pair of opposing side walls and a corner wall of the container, said at least one corner panel extending between an adjacent end panel and side panel;

a plurality of bottom panels for forming a bottom wall of the container, said bottom panels comprising a pair of bottom end panels each extending from a bottom edge of each of said pair of end panels along respective end fold lines, and a pair of bottom side panels each extending from a bottom edge of each of said pair of side panels along respective side fold lines, a first bottom side panel having a free edge spaced a first distance from a first side fold line of the respective side fold lines;

a first coupling tab integral with a first bottom end panel of said pair of bottom end panels, the first coupling tab having a free edge spaced the first distance from a first end fold line of the respective end fold lines for connecting the first bottom end panel to a first end panel of the pair of end panels, the free edge of the first coupling tab being substantially parallel to the free edge of the first bottom side panel; and a second coupling tab integral with a second bottom side panel of said pair of bottom side panels, the second coupling tab having a free edge spaced the first distance from a second side fold line of the respective side fold lines for connecting the second bottom side panel to a second side panel of the pair of side panels, the free edge of the second coupling tab being substantially parallel to the free edge of the first bottom side panel, wherein said first coupling tab attaches to one of said pair of bottom side panels, and said second coupling tab attaches to one of said pair of bottom end panels, said coupling tabs configured to upwardly direct said bottom panels when the container is moved from an erected position to a knocked-down flat position and downwardly direct said bottom panels when the container is moved from a knocked-down flat position to an erected position.

2. A blank of sheet material in accordance with claim 1 further comprising a plurality of corner panels, each corner panel extending between each adjacent end panel and side panel for forming a substantially octagonal-shaped container.

3. A blank of sheet material in accordance with claim 2 wherein each of said plurality of corner panels comprises a bottom edge, at least one of said pair of bottom end panels and at least one of said bottom side panels comprise a corner portion extension proximate each of said bottom edges of said plurality of corner panels.

4. A blank in accordance with claim 1 wherein said pair of end panels comprises a first minor side panel and a second minor side panel, said pair of side panels comprises a first major side panel and a second major side panel, said at least one corner panel comprising a first corner panel, a second corner panel, and a third corner panel, wherein:

said first minor side panel comprises a first side edge and a second side edge;

said first corner panel extends from said second side edge of said first minor side panel;

said first major side panel extends from a side edge of said first corner panel that opposes said first minor side panel;

said second corner panel extends from a side edge of said first major side panel that opposes said first corner panel;

said second minor side panel extends from a side edge of said second corner panel that opposes said first major side panel;

said third corner panel extends from a side edge of said second minor side panel that opposes said second corner panel, said first, second, and third corner panels being narrower than said first and second minor side panels; and said second major side panel extends from a side edge of said third corner panel that opposes said second minor side panel, said first and second major side panels being wider than said first and second minor side panels, wherein said pair of bottom end panels further comprises a first minor bottom panel and a second minor bottom panel and said pair of bottom side panels comprises a first major bottom panel and a second major bottom panel, said first minor bottom panel extending from a bottom edge of said first minor side panel, said first minor bottom panel comprising a base panel and said first coupling tab connected along a first tab fold line, a side edge of said first minor bottom panel at least partially defining said first coupling tab, wherein at least a portion of said side edge is at an acute angle to a bottom edge of said first corner panel;

said first major bottom panel extending from a bottom edge of said first major side panel;

said second minor bottom panel extending from a bottom edge of said second minor side panel; and said second major bottom panel extending from a bottom edge of said second major side panel, said second major bottom panel comprising a base panel and said second coupling tab connected along a second tab fold line, a side edge of said second major bottom panel at least partially defining said second coupling tab, wherein at least a portion of said side edge is at an acute angle to a bottom edge of said third corner panel, said first and second major bottom panels being wider than said first and second minor bottom panels.

5. A blank in accordance with claim 4 wherein said first major bottom panel comprises an extension portion extending from a side portion thereof toward said second minor bottom panel, and said second major bottom panel comprises an extension portion extending from a side portion thereof away from said second coupling tab.

6. A blank in accordance with claim 4 wherein said first coupling tab is adjacent to a side edge of said first major bottom panel and said second coupling tab is adjacent a side edge of said second minor bottom panel.

7. A blank in accordance with claim 1 further comprising a plurality of top panels for forming a top wall of the container, said top panels comprising a pair of top end panels each extending from a top edge of each of said pair of end panels, and a pair of top side panels each extending from a top edge of said pair of side panels.

8. A blank in accordance with claim 7 wherein each of said plurality of corner panels comprises a top edge, at least one of said pair of top side panels comprises a corner portion extension proximate each of said top edges of said plurality of corner panels.

9. A blank in accordance with claim 7 wherein said pair of top end panels comprises a first minor top panel and a second minor top panel, and said pair of top side panels comprises a first major top panel and a second major top panel, wherein:

said first minor top panel extends from a top edge of said first minor side panel;

said first major top panel extends from a top edge of said first major side panel;

said second minor top panel extends from a top edge of said second minor side panel; and said second major top panel extends from a top edge of said second major side panel.

10. A blank in accordance with claim 9 wherein said first major top panel comprises a first side extension that extends from said first major top panel toward said first minor top panel and a second side extension that extends from said first major top panel toward said second minor top panel, and wherein said second major top panel comprises a third side extension that extends from said second major top panel toward said second minor top panel and a fourth side extension that extends from said first major top panel away from said second minor top panel.

11. A blank in accordance with claim 7 wherein said pair of top side panels each comprise a pair of opposing slots and said pair of top end panels each comprise a pair of interlock tabs.

12. A blank in accordance with claim 11 wherein a first top side panel comprises a first slot and a second slot defined therein and a second top side panel comprises a third slot and a fourth slot defined therein, a first top end panel comprises a first interlock tab and a second interlock tab defined in a free edge thereof and a second top end panel comprises a third interlock tab and a fourth interlock tab defined in a free edge thereof, said first interlock tab is sized to be received within said fourth slot, said second interlock tab is sized to be received within said first slot, said third interlock tab is sized to be received within said second slot, and said fourth interlock tab is sized to be received within said third slot.

13. A blank in accordance with claim 1 further comprising:

a first glue tab extending from a side edge of one of said pair of end panels; and a second glue tab extending from a side edge of one of said pair of side panels.

14. A blank in accordance with claim 1, wherein the bottom end panels and the second bottom side panel have free edges spaced at a second distance from respective fold lines, the second distance smaller than the first distance.

15. A blank in accordance with claim 1, wherein the pair of bottom side panels overlap without being coupled together when the container is in the erected position.

16. A blank in accordance with claim 1, wherein the free edge of the first bottom side panel, the free edge of the first coupling tab, and the free edge of the second coupling tab are substantially collinear.

17. A container formed from a blank of sheet material, said container including automatically locking bottom panels, said container comprising:

a pair of end walls, a pair of side walls, and at least one corner wall interconnected along a plurality of fold lines, said at least one corner wall extending between an adjacent end wall and side wall;

a bottom wall comprising a plurality of bottom panels, said plurality of bottom panels comprising a pair of bottom end panels each extending from a bottom edge of each of the pair of end walls along respective end fold lines, and a pair of bottom side panels each extending from a bottom edge of the pair of side walls along respective side fold lines, a first bottom side panel having a free edge spaced a first distance from a first side fold line of the respective side fold lines;

a first coupling tab integral with a first bottom end panel of the pair of bottom end panels, the first coupling tab having a free edge spaced the first distance from a first end fold line of the respective end fold lines for connecting the first bottom end panel to a first end panel of the pair of end panels, the free edge of the first coupling tab being substantially parallel to the free edge of the first bottom side panel; and a second coupling tab integral with a second bottom side panel of the pair of bottom side panels, the second coupling tab having a free edge spaced the first distance from a second side fold line of the respective side fold lines for connecting the second bottom side panel to a second side panel of the pair of side panels, the free edge of the second coupling tab being substantially parallel to the free edge of the first bottom panel, wherein said first coupling tab attaches to one of said pair of bottom side panels, and said second coupling tab attaches to one of said pair of bottom end panels, said coupling tabs configured to upwardly direct said bottom panels when said container is moved from an erected position to a knocked-down flat position and downwardly direct said bottom panels when said container is moved from a knocked-down flat position to an erected position.

18. A container in accordance with claim 17 further comprising a plurality of corner walls, each corner wall extending between each adjacent end wall and side wall for forming a substantially octagonal-shaped container.

19. A container in accordance with claim 18 wherein each of said plurality of corner walls comprises a bottom edge, at least one of said pair of bottom end walls and at least one of said bottom side walls comprise a corner portion extension proximate each of said bottom edges of said plurality of corner walls.

20. A container in accordance with claim 17 wherein said pair of end walls comprises a first minor side wall and a second minor side wall, said pair of side walls comprises a first major side wall and a second major side wall, said at least one corner wall comprises a first corner wall, a second corner wall, and a third corner wall, wherein:

said first corner wall is connected along a fold line to said first minor side wall;

said first major side wall is connected along a fold line to said first corner wall such that said first major side wall opposes said first minor side wall with respect to said first corner wall;

said second corner wall is connected along a fold line to said first major side wall such that said second corner wall opposes said first corner wall with respect to said first major side wall;

said second minor side wall is connected along a fold line to said second corner wall such that said second minor side wall opposes said first major side wall with respect to said second corner wall;

said third corner wall is connected along a fold line to said second minor side wall such that said third corner wall opposes said second corner wall with respect to said second minor side wall;

said second major side wall is connected along a fold line to said third corner wall such that said second major side wall opposes said second minor side wall with respect to said third corner wall, said first and second major side walls being wider than said first and second minor side walls;

said fourth corner wall is connected to said first minor side wall and said second major side wall along respective fold lines, said first, second, third, and fourth corner walls being narrower than said first and second minor side walls; and said bottom wall is connected to bottom edges of said major and minor side walls, said bottom wall adjacent bottom edges of said corner walls, said pair of bottom end panels comprising a first minor bottom panel and a second minor bottom panel, said pair of bottom side panels comprising a first major bottom panel and a second major bottom panel, said first minor bottom panel comprising said first coupling tab and said second major bottom panel comprising said second coupling tab, wherein said first minor bottom panel is coupled to said first major bottom panel using said first coupling tab and said second minor bottom panel is coupled to said second major bottom panel using said second coupling tab.

21. A container in accordance with claim 17 wherein said pair of side walls is movable toward each other to collapse said container, wherein, when said container is in a collapsed configuration, said bottom panels are received at least within said side walls, said bottom panels being substantially parallel to said side walls in the collapsed configuration.

22. A container in accordance with claim 21 wherein said pair of side walls are movable away from each other to erect said container from the collapsed configuration without use additional bonding material, when said container is in an erected configuration, said bottom panels are automatically re-located with respect to said side walls and said end walls by movement of said side walls.

23. A container in accordance with claim 17 further comprising a top wall comprising a pair of top end panels extending from top edges of said pair of end panels and a pair of top side panels extending from top edges of said pair of side walls, said top panels movable from an opened configuration to a closed configuration.

24. A container in accordance with claim 23 wherein, when said top panels are in the closed configuration, said top end panels interlock with said top side panels to secure said top panels in the closed configuration.

25. A method of forming a container from a blank of sheet material, the blank including a pair of glue flaps, a pair of end panels, a pair of side panels, and at least one corner panel connected in series along a plurality of fold lines, said method comprising:

rotating the side panels, end panels, and the at least one corner panel about respective fold lines toward an interior surface of the blank;

coupling a first glue flap to a second glue flap to form a pair of side walls, a pair of end walls, and at least two corner walls, wherein a first corner wall includes the first and second glue flaps;

rotating a first major bottom panel about a first fold line toward an interior surface of a first side wall, the first major bottom panel having a free edge spaced at a first distance from the first fold line;

rotating a first minor bottom panel about a second fold line toward an interior surface of a first end wall, an interior surface of the first minor bottom panel contacting an exterior surface of the first major bottom panel;

rotating a second major bottom panel about a third fold line toward an interior surface of a second side wall, an interior surface of the second major bottom panel contacting exterior surfaces of the first major and minor bottom panels;

securing a first coupling tab of the second major bottom panel to the first minor bottom panel, the coupling tab of the second major bottom panel having a free edge spaced the first distance from the third fold line, the free edge of the first coupling tab being substantially parallel to the free edge of the first major bottom panel;

rotating a second minor bottom panel about a fourth fold line toward an interior surface of a second end wall, an interior surface of the second minor bottom panel contacting exterior surfaces of the major bottom panels; and securing a second coupling tab of the second minor bottom panel to the first major bottom panel, the second coupling tab of the second minor bottom panel having a free edge spaced the first distance from the fourth fold line, the free edge of the second coupling tab being substantially parallel to the free edge of the first major bottom panel.

26. A method in accordance with claim 25 further comprising moving the first side panel toward the second side panel to convert the container from an open position to a collapsed position, said moving the side panels together causes the bottom panels to rotate about respective fold lines toward the interior surfaces of the side panels and to be received within the side panels, when the container is in the collapsed position the bottom panels are substantially parallel to the side panels.

27. A method in accordance with claim 26 wherein the at least one corner panel includes a fold line that substantially bisects the at least one corner panel into a first portion and a second portion, wherein said moving the side panels together further comprises rotating the first portion of the at least one corner panel about the fold line toward the second portion of the first corner panel such that an interior surface of the first portion is adjacent an interior surface of the second portion.

28. A method in accordance with claim 26 further comprising moving the first side panel away from the second side panel to convert the container from the collapsed position to an erect position that is substantially similar to the open position without use of additional bonding material, said moving the side panels apart causes the bottom panels to rotate about respective fold lines away from the interior surfaces of the side panels and into the open position without additional manipulation by a user.

29. A method in accordance with claim 25 wherein the blank includes a pair of top end panels that are connected to respective end panels along fold lines and a pair of top side panels that are connected to respective side panels along fold lines, said method further comprising:

rotating the top end panels about the respective fold lines toward a cavity of the container; and rotating the top side panels about the respective fold lines toward the top end panels to convert the container from an open position to a closed position.

30. A method in accordance with claim 25 wherein the blank includes a pair of top end panels that are connected to respective end panels along fold lines and a pair of top side panels that are connected to respective side panels along fold lines, the top end panels each including at least one interlock tab and the top side panels each including at least one slot sized to receive a respective interlock tab, said method further comprising:

rotating the top side panels about respective fold lines toward a cavity of the container;

rotating the minor top panels about respective fold lines toward the top side panels; and interlocking the interlock tabs of the top end panels into the respective slots defined in the top side panels to convert the container from an open position to a closed position.

* * * * *